US007305952B2

(12) United States Patent
Katou et al.

(10) Patent No.: US 7,305,952 B2
(45) Date of Patent: Dec. 11, 2007

(54) ENGINE VALVE CLEARANCE ADJUSTING METHOD

(75) Inventors: Fumio Katou, Suzuka (JP); Yuuichi Oda, Suzuka (JP); Shigetoshi Inoue, Suzuka (JP); Takayuki Kanematsu, Suzuka (JP); Kanji Yamahara, Suzuka (JP)

(73) Assignee: Honda Motor Co., Ltd., Tokyo (JP)

( * ) Notice: Subject to any disclaimer, the term of this patent is extended or adjusted under 35 U.S.C. 154(b) by 152 days.

(21) Appl. No.: 10/565,416

(22) PCT Filed: Jul. 20, 2004

(86) PCT No.: PCT/JP2004/010305

§ 371 (c)(1),
(2), (4) Date: Feb. 13, 2006

(87) PCT Pub. No.: WO2005/008035

PCT Pub. Date: Jan. 27, 2005

(65) Prior Publication Data

US 2006/0130792 A1 Jun. 22, 2006

(30) Foreign Application Priority Data

Jul. 23, 2003 (JP) ..... 2003-278491
Jul. 23, 2003 (JP) ..... 2003-278492

(51) Int. Cl.
*F01L 1/14* (2006.01)

(52) U.S. Cl. ..... 123/90.48; 123/90.39; 123/90.54

(58) Field of Classification Search ..... 123/90.48, 123/90.52, 90.54, 90.39, 90.44
See application file for complete search history.

(56) References Cited

U.S. PATENT DOCUMENTS 6,205,850 B1 * 3/2001 Wehrman et al. ..... 73/119 R

FOREIGN PATENT DOCUMENTS

| | | |
|---|---|---|
| JP | 59-007716 | 1/1984 |
| JP | 03-206306 | 9/1991 |
| JP | 07-310511 | 11/1995 |
| JP | 2001-027106 | 1/2001 |

* cited by examiner

*Primary Examiner*—Ching Chang
(74) *Attorney, Agent, or Firm*—Rankin, Hill, Porter & Clark LLP

(57) ABSTRACT

A technique which allows an unskilled person to simply adjust a tappet clearance in an engine valve sometimes has a problem in that it can inaccurately adjust clearance because the abutment seat of a magnescale for detecting displacement is not a rocker arm itself and because the abutment position is deviated from the axis of an adjusting screw, due to which readjustment is required. In a method of adjusting and confirming a tappet clearance between an adjusting screw in a rocker arm and a valve stem, the adjusting screw is driven until the face portion of the valve stem is separate from a valve seat, thereafter the adjusting screw is loosened to retract the valve stem while measuring torque, an adjusting origin is determined from the measured torque, and the adjusting screw is loosened by an amount corresponding to a clearance setting specified value from the determined adjusting origin. After that the clearance setting specified value is confirmed with a displacement gauge.

3 Claims, 5 Drawing Sheets

ENGINE VALVE CLEARANCE ADJUSTING METHOD

TECHNICAL FIELD

The present invention relates to a technique for adjusting a tappet clearance in an engine valve for vehicles.

BACKGROUND ART

As a conventional technique which allows even an unskilled person to simply adjust a tappet clearance in an engine valve, a technique is disclosed in the following patent document in which an adjusting screw is driven until displacement of a rocker arm reaches a stability region, thereafter the adjusting screw is loosened until displacement of the rocker arm can be reduced by a reference value with a magnescale to set an adjusting origin, from which the adjusting screw is loosened by an amount corresponding to a predetermined value so as to set a desired clearance. (Refer to Patent document 1, for example)

Patent document 1: Japanese Patent Application Publication No. 2001-27106

DISCLOSURE OF THE INVENTION

Problems to be Solved by the Invention

In the above technique, however, the abutment seat of a magnescale for detecting displacement is not a rocker arm itself and the abutment position is deviated from the axis of an adjusting screw, thus requiring readjustment.

The present invention aims at allowing even an unskilled person to simply and accurately adjust a tappet clearance and accurately adjust it while confirming the amount of adjustment.

Means for Solving the Problems

To achieve the above aim the present invention provides a method of adjusting a tappet clearance between an adjusting screw in a rocker arm and a valve stem, in which the adjusting screw is driven until the face portion of the valve stem is separate from a valve seat, thereafter the adjusting screw is loosened to retract the valve stem while measuring torque. Then an adjusting origin is determined from the measured torque and the adjusting screw is loosened by an amount corresponding to a clearance setting specified value from the determined adjusting origin to set a desired clearance.

The present invention further provides a method in which the adjusting screw is driven until the face portion of the valve stem is separate from a valve seat, thereafter the adjusting screw is loosened to retract the valve stem while measuring torque. Then an adjusting origin is determined from the measured torque, the adjusting screw is loosened by an amount corresponding to a clearance setting specified value from the determined adjusting origin and the clearance setting specified value is confirmed with a displacement gauge.

Loosening the adjusting screw to retract the valve stem while measuring torque after a torque adjusting screw has been driven until the face portion of the valve stem is separate from a valve seat causes a torque to change from a point when the face portion of the valve stem begins to contact the valve seat. In general the torque suddenly begins decreasing from a point when the face of the valve stem begins to slightly touch the valve seat. When the face portion closely contacts the valve seat, the valve stem caused to be separate from the adjusting screw, which keeps the torque small and stable.

For this reason, the point when the torque suddenly decreases after the face portion slightly has touched the valve seat is taken as an adjusting origin. Loosening the adjusting screw by an amount corresponding to a clearance setting specified value from the adjusting origin can easily adjust the clearance. As a concrete method of loosening the adjusting screw by an amount corresponding to a clearance setting specified value, for example, a relationship between pitch and lead of the adjusting screw is converted to an angle to be used for loosening the adjusting screw.

In addition, confirming the clearance setting specified value with a displacement gauge allows highly accurate adjustment.

The present invention still further provides a device for adjusting a tappet clearance between an adjusting screw in a rocker arm and a valve stem is equipped with a driver set for manipulating the adjusting screw with a first nutrunner, a socket set for manipulating the adjusting nut with a second nutrunner, a torque gauge for measuring an operating torque of the adjusting screw, a computing unit capable of obtaining the adjusting origin from torque measurements, and a displacement gauge capable of directly or indirectly measuring displacement of the adjusting screw, wherein the displacement gauge is used for confirming a clearance setting specified value.

Where, the displacement gauge may directly measure displacement of the adjusting screw or indirectly measured it using members and the like coupled to the adjusting screw.

It is preferable to use, for example, a magnescale as a displacement gauge capable of measure a minute displacement.

Advantages of the Invention

The adjusting screw is driven until the face portion of the valve stem is separate from a valve seat, thereafter the adjusting screw is loosened to retract the valve stem while measuring torque, an adjusting origin is determined from the measured torque, and the adjusting screw is loosened by an amount corresponding to a clearance setting specified value from the determined adjusting origin to set a desired clearance. After that the clearance setting specified value is confirmed with a displacement gauge, which allows an unskilled person to simply and accurately adjust a tappet clearance.

BEST MODE FOR CARRYING OUT THE INVENTION

An embodiment of the present invention is described with reference to the accompanying drawings.

Figure 1:
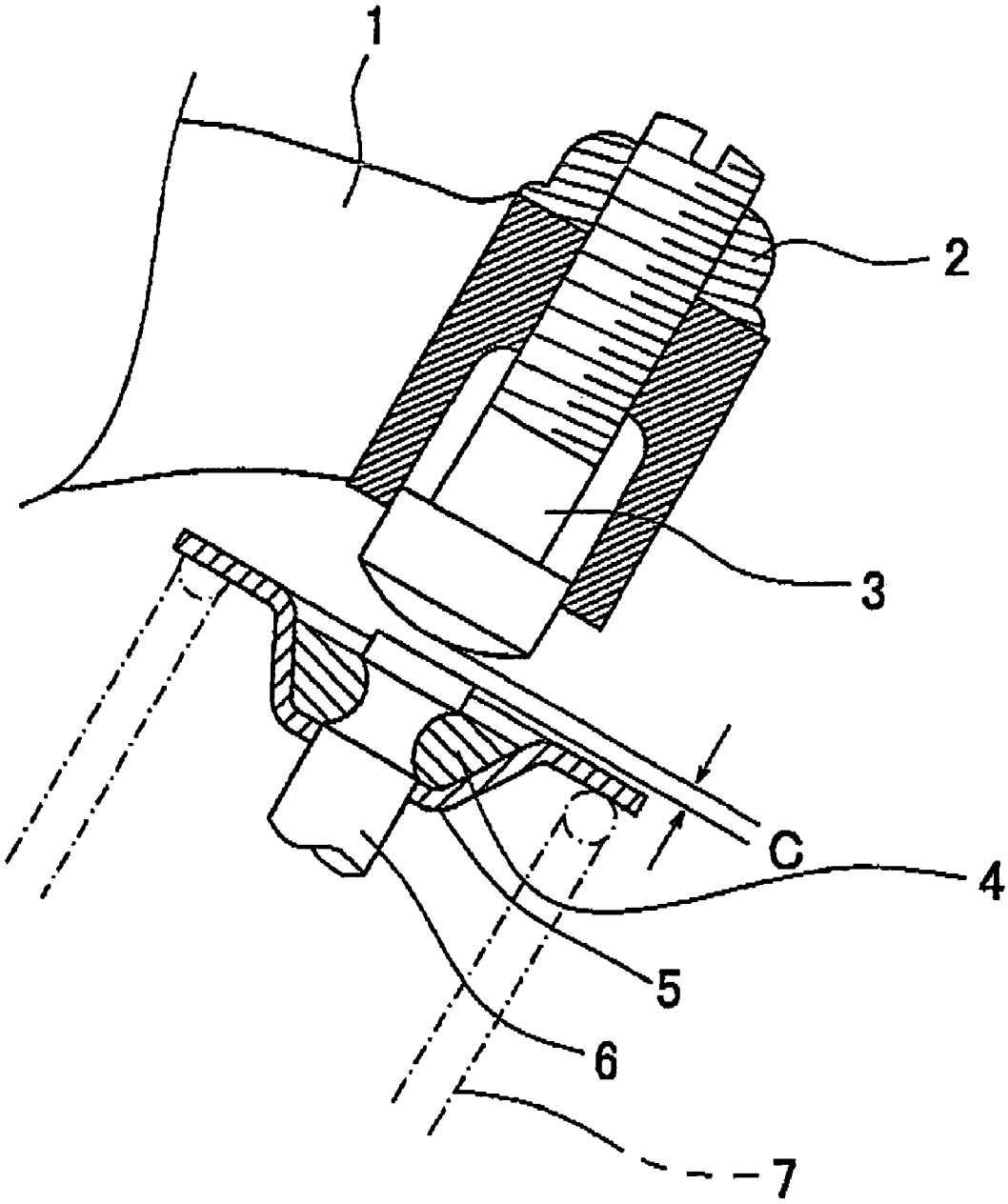
FIG. 1 is a drawing for describing clearance in an engine valve.
Figure 2:
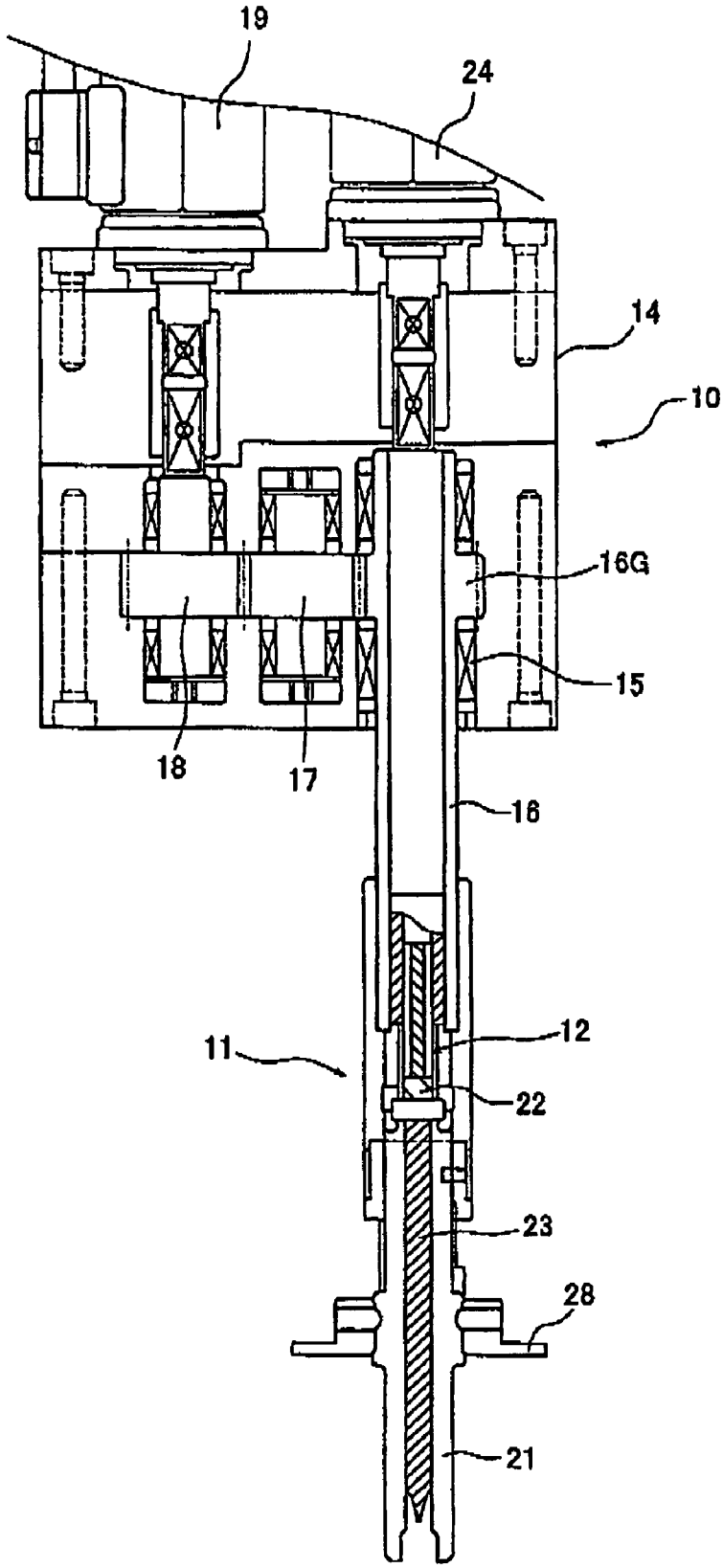
FIG. 2 is a front view of a clearance adjusting device.
Figure 3:
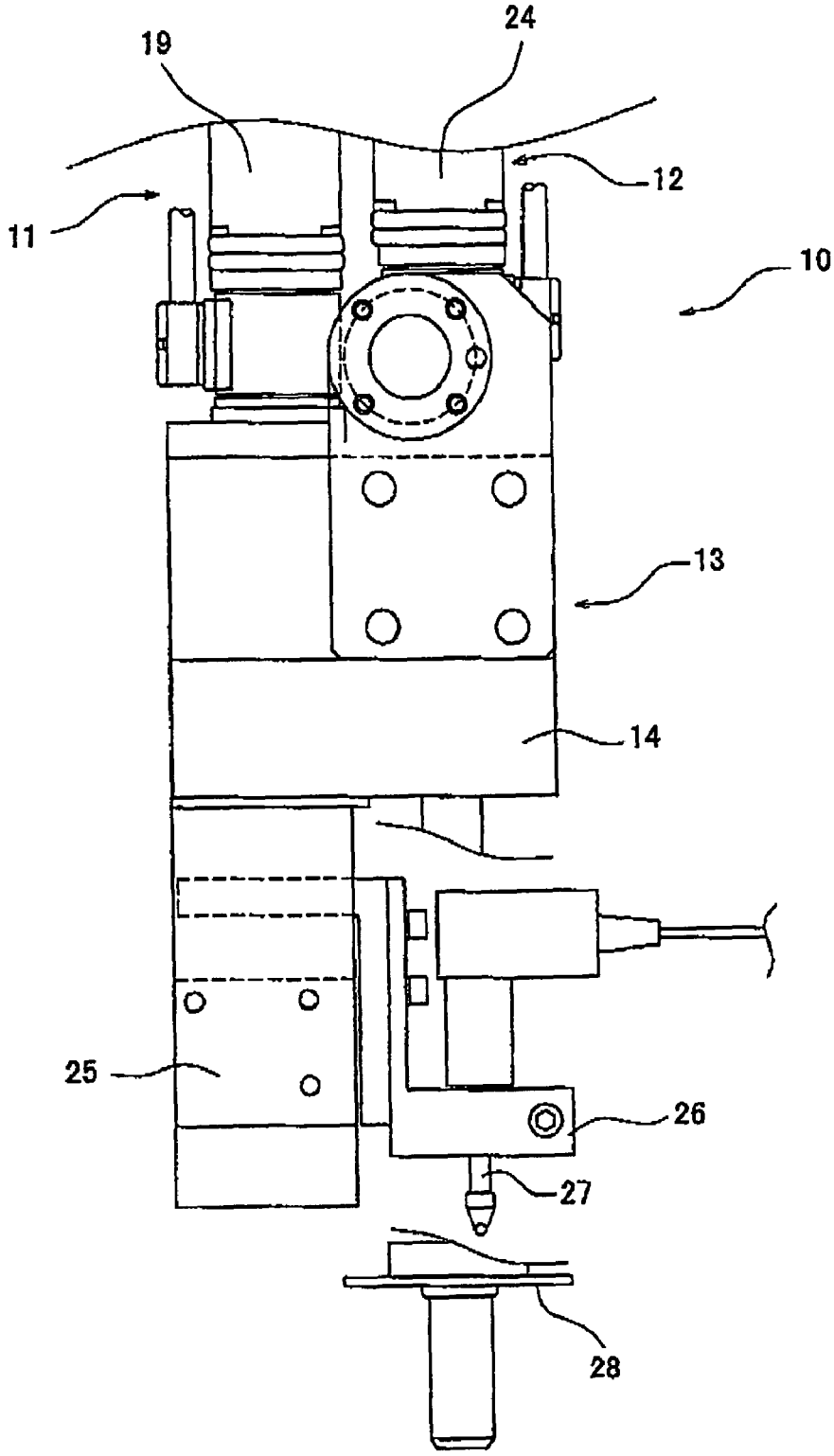
FIG. 3 is a side view of the clearance adjusting device.
Figure 4:
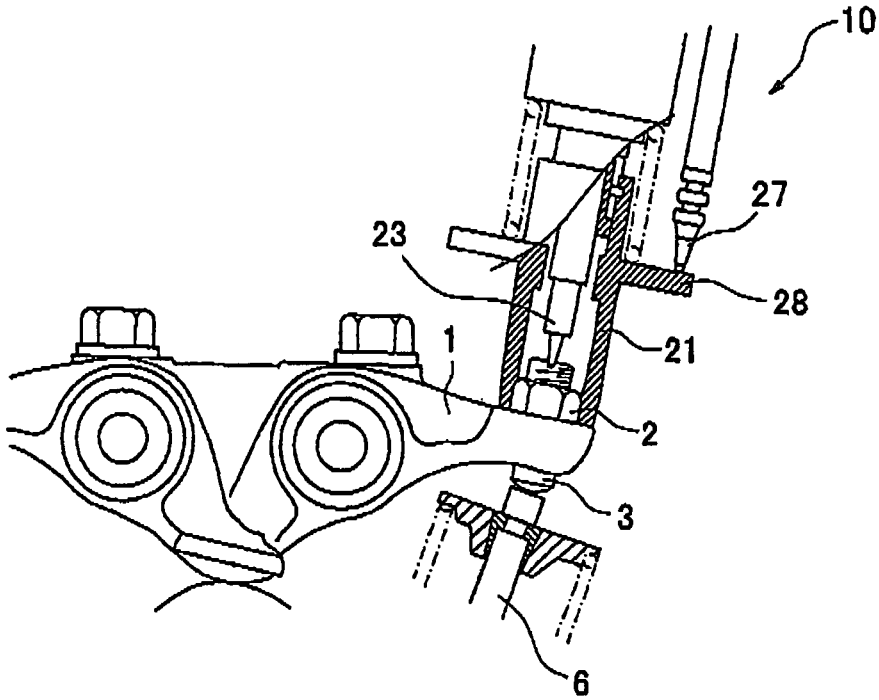
FIG. 4 a drawing for describing how to adjust clearance.
Figure 5:
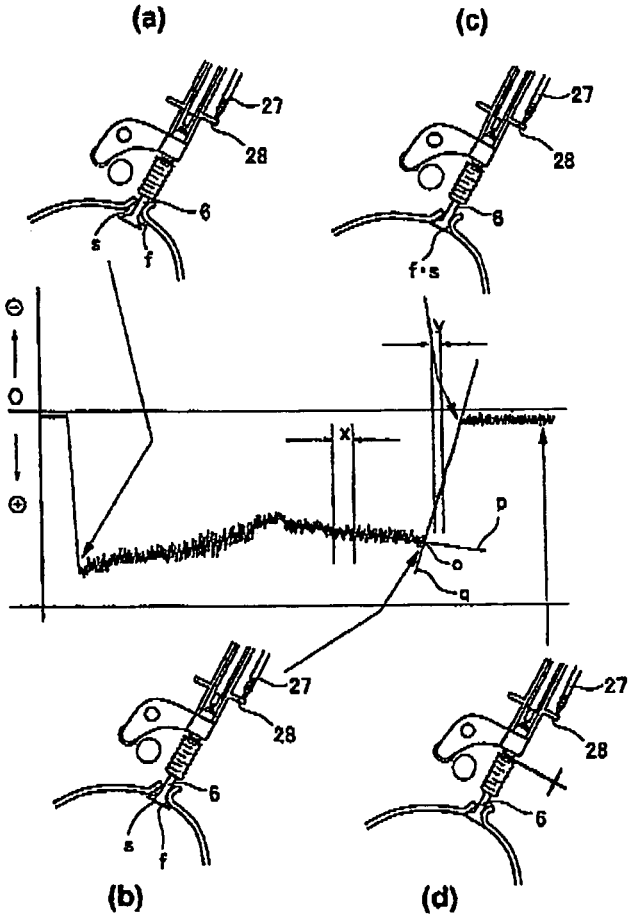
FIG. 5 is a drawing for describing a valve clearance adjusting method according to the present invention, (a) in a state where a face portion of a valve stem is separate from a valve seat, (b) in a state where the face portion slightly contacts the valve seat, (c) in a state where the face portion closely contacts the valve seat, and (d) in a state where the valve stem is separate from the adjusting screw.
Figure 6:
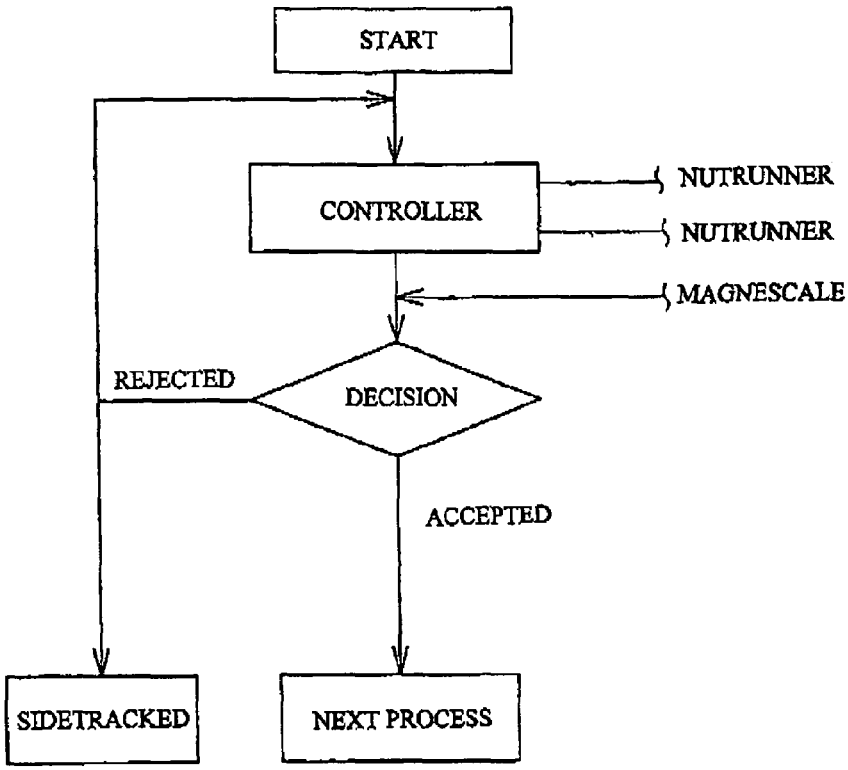
FIG. 6 is a flow chart for confirming clearance.

FIG. 1 is a drawing for describing clearance in an engine valve. FIG. 2 is a front view of a clearance adjusting device. FIG. 3 is a side view of the clearance adjusting device. FIG. 4 a drawing for describing how to adjust clearance. FIG. 5 is a drawing for describing a valve clearance adjusting method according to the present invention. FIG. 6 is a flow chart for confirming clearance.

The valve clearance adjusting method according to the present invention is characterized in that even an unskilled person can simply and precisely adjust a clearance in a valve and can more precisely adjust it by confirming the amount of adjustment, and in that the adjusting screw is driven until the face portion of a valve stem is separate from a valve seat, thereafter the adjusting screw is loosened while measuring torque to obtain an adjusting origin from change in torque, then the adjusting screw is loosened by an amount of corresponding to a clearance setting specified value from the adjusting origin, subsequently the clearance setting specified value is confirmed with a displacement gauge.

As shown in FIG. 1, the adjustment of a clearance C in the valve is made between an adjustment screw 3 fitted into the one end of rocker arm 1 of a vehicle engine through an adjusting nut 2 and a valve stem 6 fitted into a spring retainer 5 through a split cotter 4. The adjustment influences a timing to open the valve and is important in fully bringing out the performance of the engine. The spring retainer 5 is urged upward by a valve spring 7.

As shown in FIGS. 2 and 3, an adjusting device 10 for adjusting the clearance C is provided with a socket set 11 for manipulating the adjusting nut 2, a driver set 12 for manipulating the adjusting screw 3, a torque meter (not shown) for measuring torque at the time of manipulating the driver set 12, a computing unit (not shown) for reading change in the measured torque and converting it into angle, and a scale set 13 as a displacement gauge for measuring displacement of the rocker arm 1.

The socket set 11 is equipped with a cylindrical axial member 16 rotatably supported by a bearing 15 in a casing 14, a socket 21 provided on the distal end of the cylindrical axial member 16, and a driving gear 18 engaged with a gear portion 16G at the proximal end of the cylindrical axial member 16 via an idle gear 17. The driving gear 18 is provided on the output shaft of a first nutrunner 19. The drive of the first nutrunner 19 causes the socket 21 to be rotatable.

A detector 28 projecting in a radially outward direction is integrally fixed to the proximal end of the socket 21 of the cylindrical axial member 16.

The driver set 12 equipped with an axial member 22 housed in the cylindrical axial member 16, a driver portion 23 provided at the distal end of the axial member 22, and a second nutrunner 24 connected to the proximal end of the axial member 22. The drive of the second nutrunner 24 rotates the driver portion 23 independently of the socket 21.

The scale set 13 is equipped with a cylinder unit 25 disposed beneath the casing 14, and a magnescale supporting member 26 which is operated with the cylinder unit 25 and into which a magnescale 27 is screwed. The end of the magnescale can abut on the detector 28.

The method of adjusting clearance using the aforementioned clearance adjusting device 10 is described with reference to FIGS. 4 and 5.

Loosening the adjusting nut 2 by the socket 21 of the socket set 11 to drive the adjusting screw 3 with the driver 23 of the driver set 12 separates the face portion f of the valve stem 6 from the valve seat s, as shown in FIG. 5(A).

The end of the magnescale 27 is caused to abut on the detector 28, and the reading of the magnescale is set to zero.

Next, the adjust screw 2 is loosened while measuring torque. Until the face portion f of the valve stem 6 contacts the valve seat s, a torque substantially keeps constant due to the reaction force of the valve spring 7 or shows a curve without a sudden change. Once the face f of the valve stem 6 has contacted the valve seat s, the reaction force of the valve spring 7 is suddenly decreased, whereby the torque also suddenly decreases. For this reason, a point when the sudden change starts is taken as an adjusting origin.

Below is described in detail a state where the face portion f of the valve stem 6 contacts the valve seat s. A torque suddenly decreases at a point when the face portion f has slightly contacted the valve seat s (FIG. 5B). After the face portion f had closely contacted the valve seat s (FIG. 5C), the valve stem 6 is separate from the adjusting screw 3, so that a small stable torque is kept.

At this point, in the present invention, to further clarify the point when a torque suddenly decreases (FIG. 5B), angles of change in torque are calculated from change in torque between predetermined times x and y before and after a torque suddenly decreases respectively. Respective angles of change in torque are converted to straight lines p and q. An intersection where the straight lines p and q intersect with each other is taken as intersection 0.

The adjusting screw 3 is loosened from the adjusting origin by an amount corresponding to a clearance setting specified value. (A relationship between pitch and lead of the adjusting screw 3 is converted to an angle to be used for loosening the adjusting screw. For example, an angle is 240° in the present invention.)

Thereafter, the adjusting nut 2 is tightened with the socket set 11 to fasten the adjusting screw 3. At this point, however, the adjusting screw 3 is rotated along with the adjusting nut, so that the adjusting screw 3 is rotated in the direction opposite the adjusting nut 2 by a predetermined angle and by an amount of backlash of a mechanism (for example, 2° in the present invention).

This work will set the clearance C between the end of the adjusting screw 3 and valve stem 6 to the setting specified value, which is confirmed with the scale set 13. As shown in FIG. 6, when measurement results obtained by using the magnescale 27 are accepted, the device is sent to the next process. When measurement results are rejected, it is side-tracked, or adjusted again.

According to the above procedure, even an unskilled person can accurately adjust clearance because the amount of clearance can be finally confirmed with the scale set 13.

The present invention is not limited to the foregoing embodiment. One that has substantially the same configuration as the matters set forth in claims of the present invention and produces the same effect falls within the technical scope of the present invention.

For example, the concrete rotational angle for the adjusting screw 3 shown above is exemplified only. The displacement gauge is not limited to the magnescale.

INDUSTRIAL APPLICABILITY

After the adjustment screw is driven until the face portion of the valve stem is separate from the valve seat, the adjusting screw is loosened to retract the valve stem while measuring torque. A point when the torque suddenly changes is taken as an adjusting origin. The adjusting screw is then loosened from the adjusting origin by an amount corresponding to a clearance setting specified value in order to set clearance. By confirming the clearance, even an unskilled person can simply and surely adjust the clearance.

The invention claimed is:

1. A method of adjusting a tappet clearance in an engine valve between an adjusting screw in a rocker arm and a valve stem, comprising:

driving the adjusting screw until the face portion of the valve stem is separate from a valve seat, thereafter loosening the adjusting screw to retract the valve stem while measuring torque;

determining an adjusting origin from the measured torque; and loosening the adjusting screw by an amount corresponding to a clearance setting specified value from the determined adjusting origin.

2. A method of adjusting and confirming a tappet clearance in an engine valve between an adjusting screw in a rocker arm and a valve stem, comprising:

driving the adjusting screw until the face portion of the valve stem is separate from a valve seat, thereafter loosening the adjusting screw to retract the valve stem while measuring torque;

determining an adjusting origin from the measured torque;

loosening the adjusting screw by an amount corresponding to a clearance setting specified value from the determined adjusting origin; and confirming the clearance setting specified value with a displacement gauge.

3. A device for adjusting and confirming a tappet clearance in an engine valve between an adjusting screw in a rocker arm and a valve stem, comprising:

a driver set for manipulating the adjusting screw with a first nutrunner;

a socket set for manipulating the adjusting nut with a second nutrunner;

a torque gauge for measuring an operating torque of the adjusting screw;

a computing unit capable of obtaining the adjusting origin from torque measurements; and a displacement gauge capable of directly or indirectly measuring displacement of the adjusting screw, wherein the displacement gauge is used for confirming a clearance setting specified value.

* * * * *